US005987685A

United States Patent [19]

Lambert

[11] Patent Number: 5,987,685

[45] Date of Patent: Nov. 23, 1999

[54] COMBINATION CLEANING TOOL

[76] Inventor: Bill S. Lambert, 3844 W. Seagull Dr., West Valley City, Utah 84120

[21] Appl. No.: 09/160,170

[22] Filed: Sep. 25, 1998

[51] Int. Cl.[6] ..... A47L 1/06; A47L 13/12

[52] U.S. Cl. ..... 15/121; 15/118; 15/232

[58] Field of Search ..... 15/118, 121, 232

[56] References Cited

U.S. PATENT DOCUMENTS 622,809 4/1899 Keyser ..... 15/121

5,448,793 9/1995 Mallory et al. ..... 15/121

*Primary Examiner*—Randall E. Chin

[57] ABSTRACT

A combination cleaning tool for cleaning surfaces, in particular, glass surfaces such as windshields. The cleaning tool includes an elongate shaft with a head portion coupled to the distal end of the elongate shaft. An elongate resiliently flexible squeegee blade is coupled to the head portion. A resiliently compressible sponge member is coupled to the head portion distal the squeegee blade. Coupled to each end of the head portion is a resiliently compressible scrubbing pad each designed for scrubbing debris off of a surface.

9 Claims, 2 Drawing Sheets

COMBINATION CLEANING TOOL

BACKGROUND OF THE INVENTION

1. Field of the Invention

The present invention relates to windshield cleaning tools and more particularly pertains to a new combination cleaning tool for cleaning surfaces, in particular, glass surfaces such as windshields.

2. Description of the Prior Art

The use of windshield cleaning tools is known in the prior art. More specifically, windshield cleaning tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,938,535; U.S. Pat. No. 4,893,370; U.S. Pat. No. Des. 327,146; U.S. Pat. No. 3,307,212; U.S. Pat. No. 913,304; and U.S. Pat. No. 5,363,528.

While these devices fulfill their respective, particular objectives and requirements, the aforementioned patents do not disclose a new combination cleaning tool. The inventive device includes an elongate shaft with a head portion coupled to the distal end of the elongate shaft. An elongate resiliently flexible squeegee blade is coupled to the head portion. A resiliently compressible sponge member is coupled to the head portion distal the squeegee blade. Coupled to each end of the head portion is a resiliently compressible scrubbing pad each designed for scrubbing debris off of a surface.

In these respects, the combination cleaning tool according to the present invention substantially departs from the conventional concepts and designs of the prior art, and in so doing provides an apparatus primarily developed for the purpose of cleaning surfaces, in particular, glass surfaces such as windshields.

SUMMARY OF THE INVENTION

In view of the foregoing disadvantages inherent in the known types of windshield cleaning tools now present in the prior art, the present invention provides a new combination cleaning tool construction wherein the same can be utilized for cleaning surfaces, in particular, glass surfaces such as windshields.

The general purpose of the present invention, which will be described subsequently in greater detail, is to provide a new combination cleaning tool apparatus and method which has many of the advantages of the windshield cleaning tools mentioned heretofore and many novel features that result in a new combination cleaning tool which is not anticipated, rendered obvious, suggested, or even implied by any of the prior art windshield cleaning tools, either alone or in any combination thereof.

To attain this, the present invention generally comprises an elongate shaft with a head portion coupled to the distal end of the elongate shaft. An elongate resiliently flexible squeegee blade is coupled to the head portion. A resiliently compressible sponge member is coupled to the head portion distal the squeegee blade. Coupled to each end of the head portion is a resiliently compressible scrubbing pad each designed for scrubbing debris off of a surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination cleaning tool apparatus and method which has many of the advantages of the windshield cleaning tools mentioned heretofore and many novel features that result in a new combination cleaning tool which is not anticipated, rendered obvious, suggested, or even implied by any of the prior art windshield cleaning tools, either alone or in any combination thereof.

It is another object of the present invention to provide a new combination cleaning tool which may be easily and efficiently manufactured and marketed.

It is a further object of the present invention to provide a new combination cleaning tool which is of a durable and reliable construction.

An even further object of the present invention is to provide a new combination cleaning tool which is susceptible of a low cost of manufacture with regard to both materials and labor, and which accordingly is then susceptible of low prices of sale to the consuming public, thereby making such combination cleaning tool economically available to the buying public.

Still yet another object of the present invention is to provide a new combination cleaning tool which provides in the apparatuses and methods of the prior art some of the advantages thereof, while simultaneously overcoming some of the disadvantages normally associated therewith.

Still another object of the present invention is to provide a new combination cleaning tool for cleaning surfaces, in particular, glass surfaces such as windshields.

Yet another object of the present invention is to provide a new combination cleaning tool which includes an elongate shaft with a head portion coupled to the distal end of the elongate shaft. An elongate resiliently flexible squeegee blade is coupled to the head portion. A resiliently compressible sponge member is coupled to the head portion distal the squeegee blade. Coupled to each end of the head portion is a resiliently compressible scrubbing pad each designed for scrubbing debris off of a surface.

Still yet another object of the present invention is to provide a new combination cleaning tool that includes portions adapted for scrubbing debris such as bug splatters and bird guano off of a windshield more efficiently than traditional combination squeegee sponge tools.

Even still another object of the present invention is to provide a new combination cleaning tool that has detachable scrubbing portions for easy and convenient replacement when worn.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
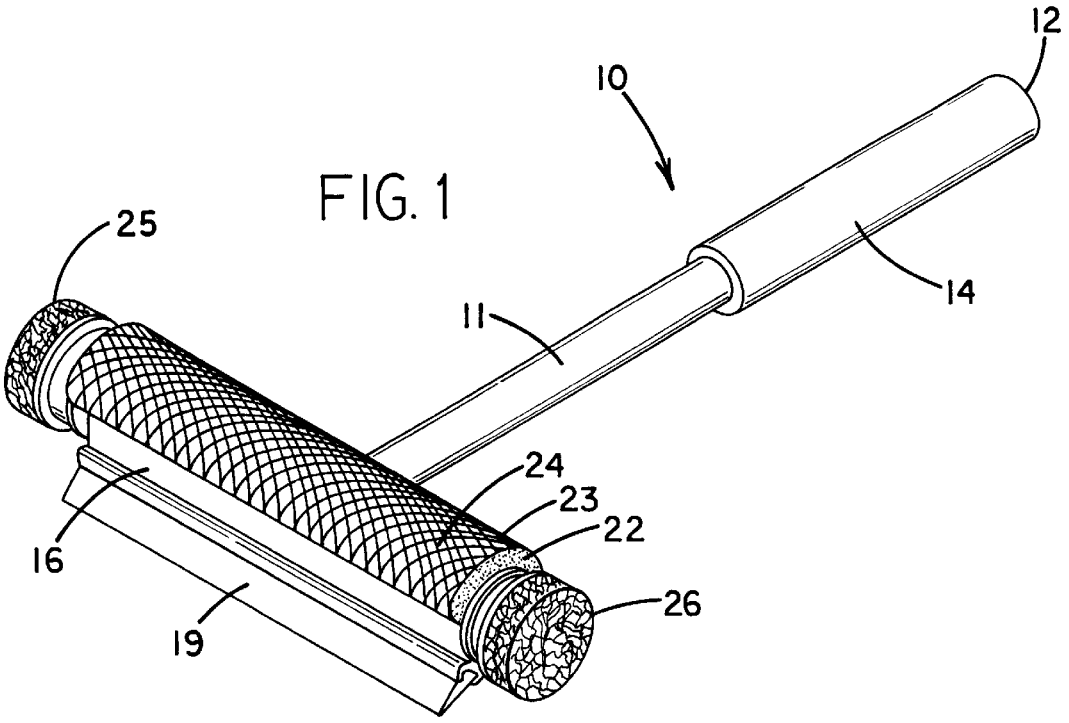
FIG. 1 is a schematic perspective view of a new combination cleaning tool according to the present invention.
Figure 2:
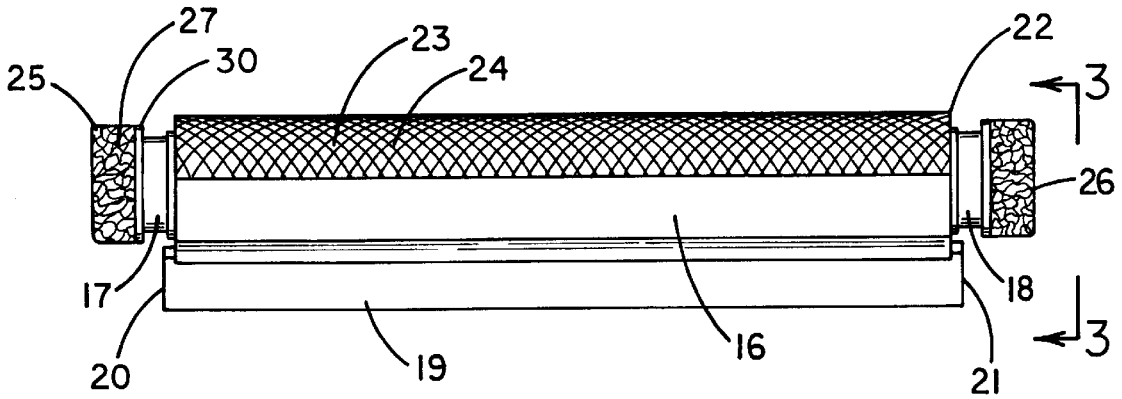
FIG. 2 is a schematic distal end view of the present invention.
Figure 3:
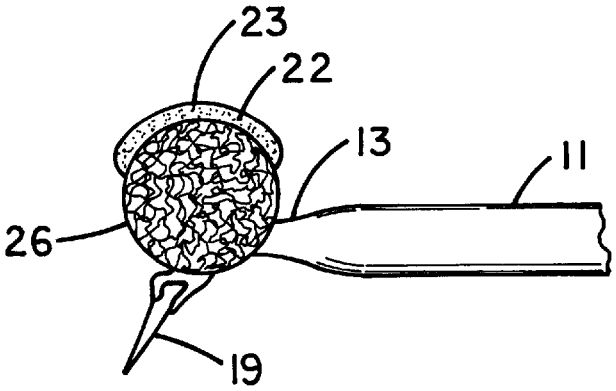
FIG. 3 is a schematic side view of the head portion of the present invention taken from line 3—3 of FIG. 2.
Figure 4:
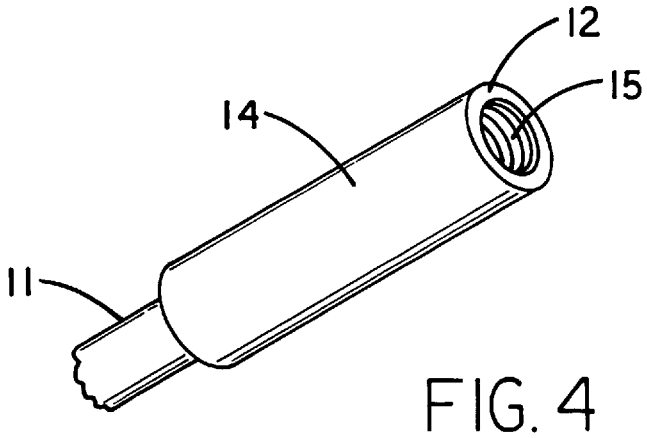
FIG. 4 is a schematic perspective view of the proximal end of the present invention.

With reference now to the drawings, and in particular to FIGS. 1 through 5 thereof, a new combination cleaning tool embodying the principles and concepts of the present invention and generally designated by the reference numeral 10 will be described.

As best illustrated in FIGS. 1 through 5, the combination cleaning tool 10 generally comprises an elongate shaft 11 with a head portion 16 coupled to the distal end 13 of the elongate shaft 11. An elongate resiliently flexible squeegee blade 19 is coupled to the head portion 16. A resiliently compressible sponge member 22 is coupled to the head portion 16 distal the squeegee blade 19. Coupled to each end of the head portion 16 is a resiliently compressible scrubbing pad 25,26 each designed for scrubbing debris off of a surface.

In use, the cleaning tool 10 is designed for cleaning surfaces in particular glass surfaces such as a windshield. In closer detail, an elongate shaft 11 has opposite proximal and distal ends 12,13, and a longitudinal axis extending between the ends 12,13 of the elongate shaft 11. The elongate shaft 11 has a length defined between the proximal and distal ends 12,13 of the elongate shaft 11 preferably greater than about 6 inches. Ideally, the length of the elongate shaft 11 is about 24 inches. In the preferred embodiment, the elongate shaft 11 has a generally cylindrical outer configuration and a generally circular transverse cross section generally perpendicular to the longitudinal axis of the elongate shaft 11.

The elongate shaft 11 has a gripping portion 14 adjacent the proximal end 12 of the elongate shaft 11. The gripping portion 14 is designed for grasping by a hand of a user. In the preferred embodiment, the gripping portion 14 has a generally cylindrical outer configuration and a generally circular transverse cross section generally perpendicular to the longitudinal axis of the elongate shaft 11. The transverse cross section of the gripping portion 14 has a diameter greater than a diameter of the transverse cross section of the elongate shaft 11. Preferably, the proximal end 12 of the elongate shaft 11 also has threaded bore 15 therein. The threaded bore 15 is designed for threadably receiving a threaded end of an elongate extension rod designed for extending the overall length of the elongate shaft 11 so that the cleaning tool 10 may be used on more distant surfaces. Ideally, the threaded bore 15 of the proximal end 12 of the elongate shaft 11 has a longitudinal axis coaxial with the longitudinal axis of the elongate shaft 11.

The head portion 16 is coupled to the distal end 13 of the elongate shaft 11. Preferably, the head portion 16 is generally cylindrical in configuration and has a pair of opposite ends 17,18, and a longitudinal axis extending between the ends 17,18 of the head portion 16. The head portion 16 is ideally generally cylindrical in configuration and has a generally circular transverse cross section perpendicular to the longitudinal axis of the head portion 16. The transverse cross section of the head portion 16 defines a diameter and a circumference. The longitudinal axis of the head portion 16 is extended generally perpendicular to the longitudinal axis of the elongate shaft 11. The head portion 16 has a length defined between the ends 17,18 of the head portion 16. Preferably, the length of the head portion 16 is more than about one-quarter the length of the elongate shaft 11. Even more preferably, the length of the head portion 16 is about one-half the length of the elongate shaft 11. In a preferred embodiment, the length of the head portion 16 is greater than about 6 inches to permit cleaning of an adequate amount of a windshield in a single pass. In an ideal embodiment, the length of the head portion 16 is about 12 inches.

The elongate resiliently flexible squeegee blade 19 is coupled to the head portion 16. In use, the squeegee blade 19 is designed for drawing across a surface to remove water from the surface. The squeegee blade 19 ideally comprises a resiliently flexible rubber or plastic material. The squeegee blade 19 has a pair of opposite ends 20,21 and a length defined between the ends 20,21 of the squeegee blade 19. The squeegee blade 19 has a generally triangular cross section transverse the length of the squeegee blade 19. The length of the squeegee blade 19 extends between the ends 17,18 of the head portion 16. Preferably, the length of the squeegee blade 19 is extended generally perpendicular to the longitudinal axis of the elongate shaft 11 and generally parallel to the longitudinal axis of the head portion 16. In a preferred embodiment, the length of the squeegee blade 19 extends across more than one-half of the length of the head portion 16. Ideally, the length of the squeegee blade 19 extends across essentially the entire length of the head portion 16.

The resiliently compressible sponge member 22 is coupled to the head portion 16 distal the squeegee blade 19.

The sponge member 22 is designed for absorbing fluid therein. The sponge member 22 has an exterior face 23 and a length extending between the ends 17,18 of the head portion 16. The length of the sponge member 22 extends generally across the entire length of the head portion 16. Preferably, the sponge member 22 has a generally semi-circular transverse cross section generally perpendicular to the longitudinal axis of the head portion 16. The transverse cross section of the sponge member 22 preferably extends across about one-half of the circumference of the head portion 16. Preferably, the sponge member 22 has a fabric material mesh netting 24 over the exterior face 23 of the sponge member adapted for aiding scrubbing off of debris from a windshield when using the sponge member on the windshield.

The tool 10 includes a pair of resiliently compressible scrubbing pads 25,26. Each of the scrubbing pads 25,26 comprises an aggregation of resiliently flexible filaments 27 (typically plastic filaments) forming an abrasive surface designed for scrubbing debris such as insects and guano off of a glass surface without scratching the glass surface. One of the scrubbing pads is detachably coupled to one of the ends of the head portion while another of the scrubbing pads is detachably coupled to another of the ends of the head portion. Each of the scrubbing pads 25,26 has a generally disk-shaped outer configuration with a center axis which are preferably generally coaxial with the longitudinal axis of the head portion 16.

Figure 5:
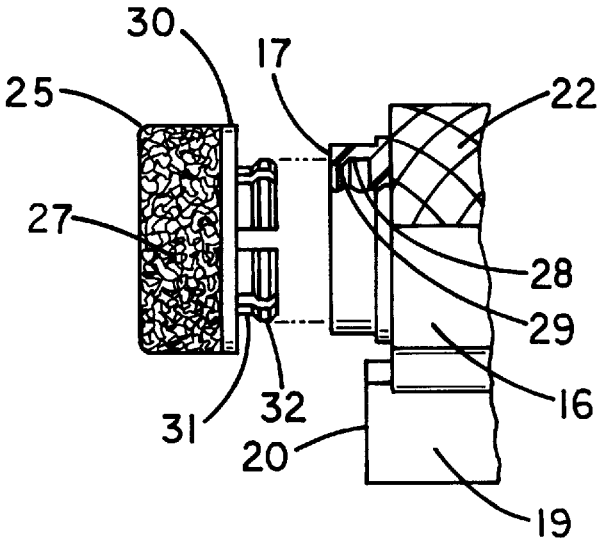
FIG. 5 is a schematic exploded side view of the present invention illustrating the attachment of a scrubbing pad to one of the end of the head portion.

In a preferred embodiment, each of the ends 17,18 of the head portion 16 has a generally circular hole 28 therein. Each of the ends 17,18 of the head portion 16 also has an annular ridge 29 extending radially inwards into the associated hole 28 of the head portion 16. The holes 28 of the head portion 16 are generally coaxial with the longitudinal axis of the head portion 16. Each of the scrubbing pads 25,26 has a generally circular rigid base portion 30 coupled thereto. The base portions 30 of the scrubbing pads 25,26 each has plurality of resiliently deflectable tangs 31 outwardly extending therefrom. Ideally, as illustrated in FIG. 5, each associated pair of scrubbing pads and base portions has diameters generally equal to one another. The tangs 31 of each base portion 30 are arranged in a generally ring shaped configuration on the respective base portion 30, each of the tangs 31 has terminating at an outwardly radiating ridge 32. The tangs 31 of each of the scrubbing pads 25,26 are inserted into the hole 28 of the adjacent associated end of the head portion 16 past the respective annular ridge 29 of the associated hole 28. The tangs 31 are biased radially outwards from the holes 28 of the ends 17,18 of the head portion 16 to releasably hold the scrubbing pads 25,26 to the ends 17,18 of the head portion 16.

In use, the sponge member 22 is soaked in a cleaning fluid such as water mixed with a soap detergent or windshield wiper fluid and then run over the windshield to wet the windshield. One of the scrubbing pads 25,26 is then rubbed over debris on the windshield to loosen and remove the debris from the windshield. Finally, the squeegee blade 19 is then run over the windshield to remove the fluid and loosed debris from the windshield.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cleaning tool, comprising:

an elongate shaft having opposite proximal and distal ends, and a longitudinal axis extending between said ends of said elongate shaft;

a head portion being coupled to said distal end of said elongate shaft, said head portion having a pair of opposite ends, and a longitudinal axis extending between said ends of said head portion;

an elongate resiliently flexible squeegee blade being coupled to said head portion;

said squeegee blade having a pair of opposite ends and a length defined between said ends of said squeegee blade, said length of said squeegee blade extending between said ends of said head portion;

a resiliently compressible sponge member being coupled to said head portion, said sponge member having a length extending between said ends of said head portion;

a pair of resiliently compressible scrubbing pads for scrubbing debris off of a surface; and one of said scrubbing pads being coupled to one of said ends of said head portion, another of said scrubbing pads being coupled to another of said ends of said head portion.

2. The cleaning tool of claim 1, wherein said elongate shaft has a gripping portion adjacent said proximal end of said elongate shaft.

3. The cleaning tool of claim 2, wherein said proximal end of said elongate shaft has a threaded bore therein, said threaded bore being adapted for threadably receiving a threaded end of an elongate extension rod.

4. The cleaning tool of claim 1, wherein said head portion is generally cylindrical in configuration and has a generally circular transverse cross section perpendicular to said longitudinal axis of said head portion.

5. The cleaning tool of claim 1, wherein each of said scrubbing pads comprises an aggregation of resiliently flexible filaments forming an abrasive surface adapted for scrubbing debris off of a surface.

6. The cleaning tool of claim 1, wherein each of said scrubbing pads has a generally disk-shaped outer configuration having a center axis, said center axes of said scrubbing pads being generally coaxial with said longitudinal axis of said head portion.

7. The cleaning tool of claim 1, wherein each of said ends of said head portion has a hole therein, each of said ends of said head portion having an annular ridge extending radially inwards into the associated hole of said head portion, wherein each of said scrubbing pads has a base portion coupled thereto, said base portions of said scrubbing pads each having plurality of resiliently deflectable tangs outwardly extending therefrom, said tangs of each base portion being arranged in a generally ring shaped configuration on the respective base portion, each of said tangs having an outwardly radiating ridge, said tangs of each of said scrubbing pads being inserted into the hole of the adjacent associated end of said head portion past the respective annular ridge of the associated hole.

8. The cleaning tool of claim 7, wherein said tangs are biased radially outwards from said holes of said ends of said head portion to releasably hold said scrubbing pads to said ends of said head portion.

9. A cleaning tool, comprising:

an elongate shaft having opposite proximal and distal ends, and a longitudinal axis extending between said ends of said elongate shaft;

said elongate shaft having a length defined between said proximal and distal ends of said elongate shaft greater than about 6 inches, wherein said length of said elongate shaft is about 24 inches;

said elongate shaft having a generally cylindrical outer configuration and a generally circular transverse cross section generally perpendicular to said longitudinal axis of said elongate shaft;

said elongate shaft having a gripping portion adjacent said proximal end of said elongate shaft, said gripping portion having a generally cylindrical outer configuration and a generally circular transverse cross section generally perpendicular to said longitudinal axis of said elongate shaft;

said transverse cross section of said gripping portion having a diameter greater than a diameter of said transverse cross section of said elongate shaft;

said proximal end of said elongate shaft having a threaded bore therein, said threaded bore being adapted for threadably receiving a threaded end of an elongate extension rod, said threaded bore of said proximal end of said elongate shaft having a longitudinal axis coaxial with said longitudinal axis of said elongate shaft;

a head portion being coupled to said distal end of said elongate shaft, said head portion being generally cylindrical in configuration and having a pair of opposite ends, and a longitudinal axis extending between said ends of said head portion;

said head portion being generally cylindrical in configuration and having a generally circular transverse cross section perpendicular to said longitudinal axis of said head portion;

said transverse cross section of said head portion defining a diameter and a circumference;

said longitudinal axis of said head portion being extended generally perpendicular to said longitudinal axis of said elongate shaft;

said head portion having a length defined between said ends of said head portion, said length of said head portion being more than about one-quarter said length of said elongate shaft, wherein said length of said head portion is about one-half said length of said elongate shaft;

said length of said head portion being greater than about 6 inches, wherein said length of said head portion is about 12 inches;

an elongate resiliently flexible squeegee blade being coupled to said head portion;

said squeegee blade having a pair of opposite ends and a length defined between said ends of said squeegee blade, said length of said squeegee blade extending between said ends of said head portion;

said length of said squeegee blade being extended generally perpendicular to said longitudinal axis of said elongate shaft and generally parallel to said longitudinal axis of said head portion;

said length of said squeegee blade extending across more than one-half of said length of said head portion, wherein said length of said squeegee blade extends across essentially the entire length of said head portion;

a resiliently compressible sponge member being coupled to said head portion distal said squeegee blade, said sponge member being adapted for absorbing fluid, said sponge member having an exterior face and a length extending between said ends of said head portion, said length of said sponge member extending generally across the entire length of said head portion, said sponge member having a generally semi-circular transverse cross section generally perpendicular to said longitudinal axis of said head portion, said transverse cross section of said sponge member extending across about one-half of said circumference of said head portion;

said sponge member having a mesh netting over said exterior face of said sponge member, said mesh netting being adapted for scrubbing debris from the windshield;

a pair of resiliently compressible scrubbing pads, each of said scrubbing pads comprising an aggregation of resiliently flexible filaments forming an abrasive surface adapted for scrubbing debris off of a surface;

one of said scrubbing pads being coupled to one of said ends of said head portion, another of said scrubbing pads being coupled to another of said ends of said head portion;

each of said scrubbing pads having a generally disk-shaped outer configuration having a center axis, said center axes of said scrubbing pads being generally coaxial with said longitudinal axis of said head portion;

each of said ends of said head portion having a generally circular hole therein, each of said ends of said head portion having an annular ridge extending radially inwards into the associated hole of said head portion, said holes of said head portion being generally coaxial with said longitudinal axis of said head portion;

each of said scrubbing pads having a generally circular base portion coupled thereto, said base portions of said scrubbing pads each having plurality of resiliently deflectable tangs outwardly extending therefrom;

each associated pair of scrubbing pads and base portions having diameters generally equal to one another;

said tangs of each base portion being arranged in a generally ring shaped configuration on the respective base portion, each of said tangs having an outwardly radiating ridge;

said tangs of each of said scrubbing pads being inserted into the hole of the adjacent associated end of said head portion past the respective annular ridge of the associated hole; and said tangs being biased radially outwards from said holes of said ends of said head portion to releasably hold said scrubbing pads to said ends of said head portion.

* * * * *